US006382142B1

(12) United States Patent
Chen

(10) Patent No.: US 6,382,142 B1
(45) Date of Patent: May 7, 2002

(54) STEAM/IRONING DUAL MODE CLEANING APPARATUS

(75) Inventor: Shi-Fu Chen, Changhua (TW)

(73) Assignee: Mitco International Ltd., Hsin Tien (TW)

( * ) Notice: Subject to any disclaimer, the term of this patent is extended or adjusted under 35 U.S.C. 154(b) by 0 days.

(21) Appl. No.: 09/818,833

(22) Filed: Mar. 28, 2001

(51) Int. Cl.[7] ..... A47L 5/12; A47L 7/02
(52) U.S. Cl. ..... 122/379; 15/327.1; 15/327.2
(58) Field of Search ..... 122/379, 508, 122/DIG. 10; 15/320, 327.1, 327.2, 321; D32/17, 23

(56) References Cited

U.S. PATENT DOCUMENTS 2,572,317 A * 10/1951 Chausse ..... 122/250 R
4,361,928 A * 12/1982 Schulz ..... 15/326
4,949,424 A * 8/1990 Shero ..... 15/321
5,371,918 A * 12/1994 Shero ..... 15/321

* cited by examiner

*Primary Examiner*—Gregory A. Wilson
(74) *Attorney, Agent, or Firm*—Browdy and Neimark

(57) ABSTRACT

A steam/ironing dual mode cleaning apparatus includes a housing defining a receiving chamber, a water tank unit mounted in the receiving chamber and adapted to hold water, a steam boiler mounted in the receiving chamber and adapted to boil water into steam, and a water pump unit mounted in the receiving chamber and horizontally aligned with the water tank unit and the steam boiler, the water pump unit having a water inlet fitting connected to a water output port of the water tank unit through a first water pipe, a water outlet fitting connected to a water input port of the steam boiler through a second water pipe, and a motor pump controlled to pump water from the water tank unit to the steam boiler for boiling.

4 Claims, 4 Drawing Sheets

STEAM/IRONING DUAL MODE CLEANING APPARATUS

BACKGROUND OF THE INVENTION

The present invention relates to cleaning apparatus and, ore specifically, to a steam/ironing dual mode cleaning apparatus.

A regular ironing machine 1, as shown in FIG. 1, is generally comprised of a housing 2, a water tank 3, and a steam oiler 4. The housing 2 has a bottom side equipped with wheels 5 for enabling the ironing machine 1 to be moved on the floor. The water tank 3 is provided inside the housing 2 and adapted to hold water, having a bottom water outlet 3*a* for output of water to the steam boiler 4. The steam boiler 4 is mounted inside the housing 2, having a water inlet 4*a* connected to the water outlet 3*a* of the water tank 3 by a hose 6. Through the hose 6, water is guided from the water tank 3 to the steam boiler 4 for boiling into steam. Because water is guided from the water tank 3 to the steam boiler 4 through the hose 6, the water tank 3 must be disposed at an elevation higher than the steam boiler 4 so that the water level in the water tank 3 can be constantly maintained higher than the water level in the steam boiler 4, enabling water to flow automatically from the water tank 3 to the steam boiler 4 subject to atmospheric pressure. Because the water tank 3 must be disposed at an elevation higher than the steam boiler 4, the vertical size of the ironing machine cannot be reduced to the desired level, resulting in inconvenience in use. Further, the pressure produced from high temperature may force water to flow back from the steam boiler 4 to the water tank 3, causing the steam boiler 4 to heat open air.

SUMMARY OF THE INVENTION

The present invention has been accomplished under the circumstances in view. It is the one object of the present invention to provide a steam/ironing dual mode cleaning apparatus, which has a flattened outer structure convenient for use. It is another object of the present invention to provide a steam/ironing dual mode cleaning apparatus, which continuously stably supplies water to the steam boiler, preventing the steam boiler from heating when empty. According to one aspect of the present invention, the steam/ironing dual mode cleaning apparatus comprises a housing defining a receiving chamber, a water tank unit mounted in the receiving chamber and adapted to hold water, a steam boiler mounted in the receiving chamber and adapted to boil water into steam, and a water pump unit mounted in the receiving chamber and horizontally aligned with the water tank unit and the steam boiler, the water pump unit having a water inlet fitting connected to a water output port of the water tank unit through a first water pipe, a water outlet fitting connected to a water input port of the steam boiler through a second water pipe, and a motor pump controlled to pump water from the water tank unit to the steam boiler for boiling. According to another aspect of the present invention, a water level-actuated switch is mounted inside the water tank unit and adapted to cut off power supply when the water level in the water tank unit drops below a predetermined range.

DETAILED DESCRIPTION OF THE PREFERRED EMBODIMENT

Figure 1:
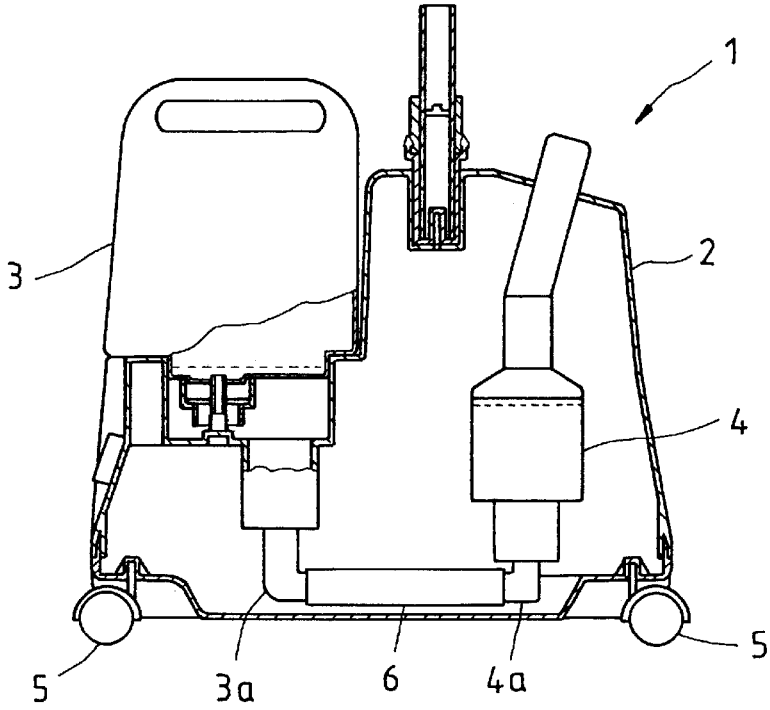
FIG. 1 PRIOR ART
FIG. 1 illustrates an ironing machine according to the prior art.
Figure 2:
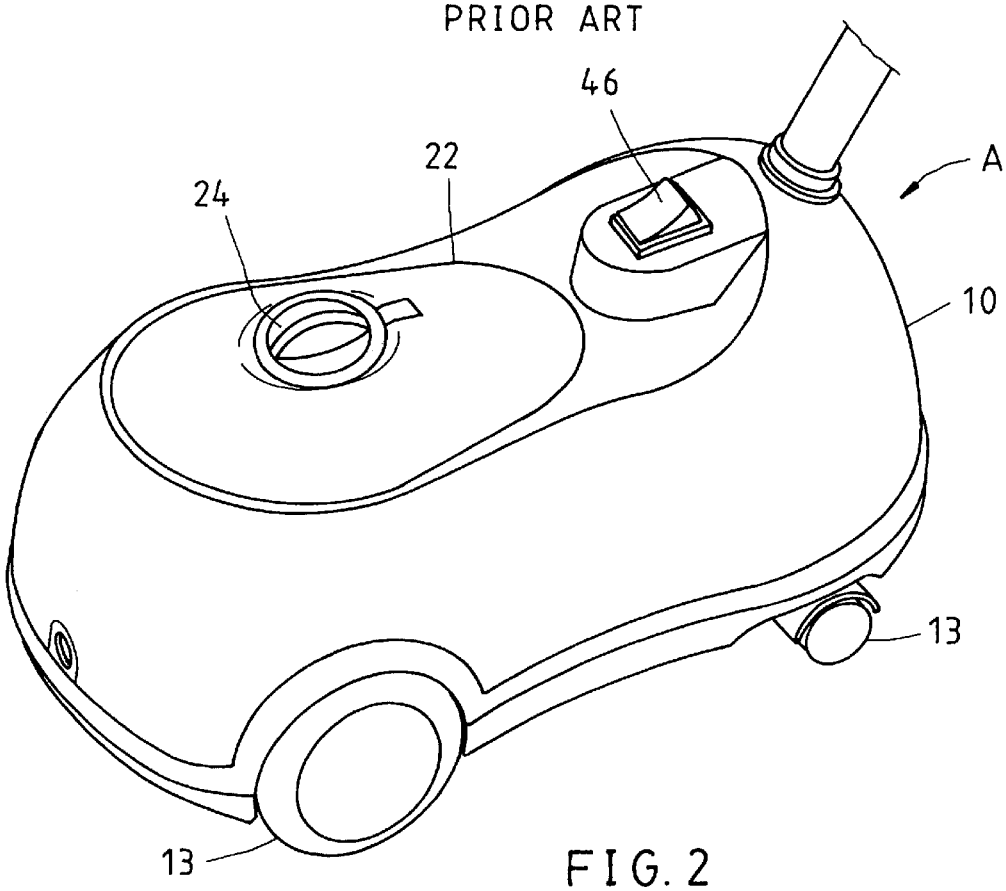
FIG. 2 is an elevational view of a steam/ironing dual mode cleaning apparatus according to the present invention.

Referring to FIGS. from 2 through 4, a steam/ironing dual mode cleaning apparatus A is shown comprised of a housing 10, a water tank unit 20, a steam boiler 30, and a water pump unit 40.

The housing 10 comprises a receiving chamber 11 disposed on the inside and adapted to receive the water tank unit 20, the steam boiler 30 and the water pump unit 40, an opening 12 disposed on the outside in communication with the receiving chamber 11, and a plurality of wheels 13 disposed at the bottom side for enabling the steam/ironing dual mode cleaning apparatus to be moved on the floor conveniently.

The water tank unit 20 comprises a tank body 21 of substantially U-shaped profile extended from the periphery of the opening 12 of the housing 10 toward the inside of the receiving chamber 11 and adapted to hold water, a tank cover 22 fitting the periphery of the opening 12 of the housing 10 and adapted to close the passage of the opening 12, the tank cover 22 having a filling port 23 disposed in communication with the inside space of the tank body 21 so that water can be filled into the tank body 21 through the filling port 23, and a seal 24 fitting the periphery of the filling port 23 and adapted to close the passage of the filling port 23, a filter 25 of substantially U-shaped profile downwardly extended from the periphery of the filling port 23 and adapted to remove solid matter from water being filled through the filling port 23 into the tank body 21, a water outlet 26 extended through the bottom sidewall of the tank body 21, a three-way connector 27 provided at the bottom side of the tank body 21, the three-way connector 27 having a first end connected to the water outlet 26 to receive water from the tank body 21, a second end provided with a drain control switch 271, which is normally turned off and can be turned on to let water flow out of the housing 10, and a third end provided with a water outlet fitting 272, and a water level-actuated switch 28 mounted inside the tank body 21 and adapted to cut off power supply when the water level in the tank body 21 drops below a predetermined range. The water level-actuated switch 28 comprises an upright 281 fixedly mounted in the tank body 21 and upwardly extended from the bottom sidewall of the tank body 21, a float arm 282 pivoted with a middle part thereof to the upright 281, a float 283 fixedly fastened to one end of the float arm 282, the float 283 being a hollow airtight member filled up with air, a push rod 284, the push rod 284 having one end connected to one end of the float arm 282 remote from the float 283 and an opposite end inserted through a hole (not shown) on the bottom sidewall of the tank body 21, a gasket 285 fixedly mounted in the bottom sidewall of the tank body 21 around the push rod 284 to seal the gap, and a water valve switch 286 mounted on the outside of the tank body 21 at a bottom side and connected in series to the electric circuit of the apparatus. When the water level in the tank body 21 rises, the float 283 floats upwards with the water level to turn the float arm 282 in one direction, thereby causing the float arm 282 to lower the push rod 284 and to further force the push rod 284 to switch on the water valve switch 286, and therefore the apparatus starts to run. On the contrary, when the water level in the tank body 21 drops, the float 283 lowers with the water level to turn the float arm 282 in the reversed direction, thereby causing the float arm 282 to lift the push rod 284. After disconnection of the push rod 284 from the water valve switch 286, the water valve switch 286 is switched off to cut off power supply, and therefore the apparatus is shut down. In general, the water level-actuated switch 28 controls the operation of the apparatus. When the water level in the tank body 21 is high, the water level-actuated switch 28 allows the apparatus to operate normally. When the water level in the tank body 21 is low, the water level-actuated switch 28 shuts off the apparatus, preventing the steam boiler 30 from heating open air.

Figure 3:
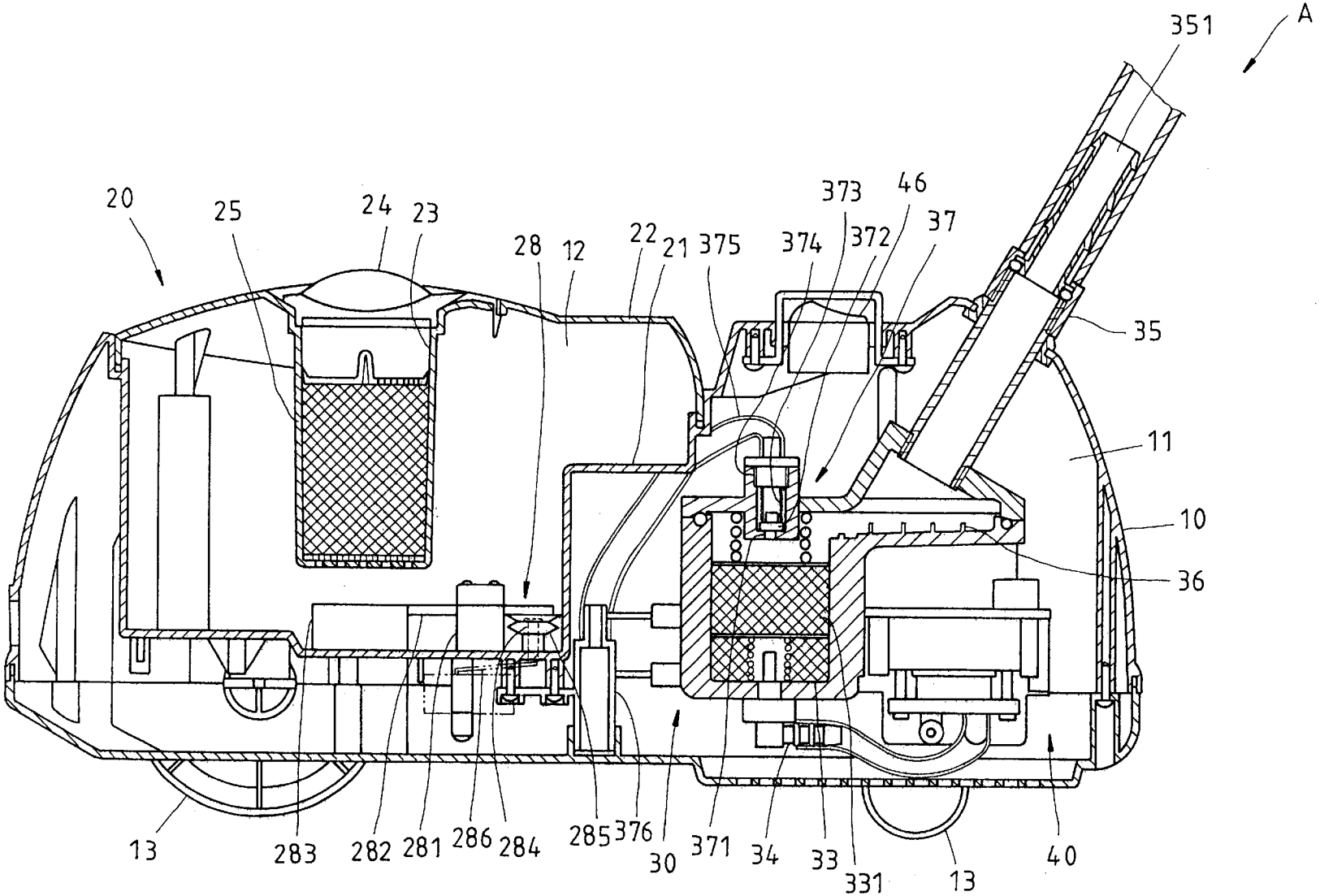
FIG. 3 is a side view in section in an enlarged scale of the steam/ironing dual mode cleaning apparatus shown in FIG. 2.
Figure 4:
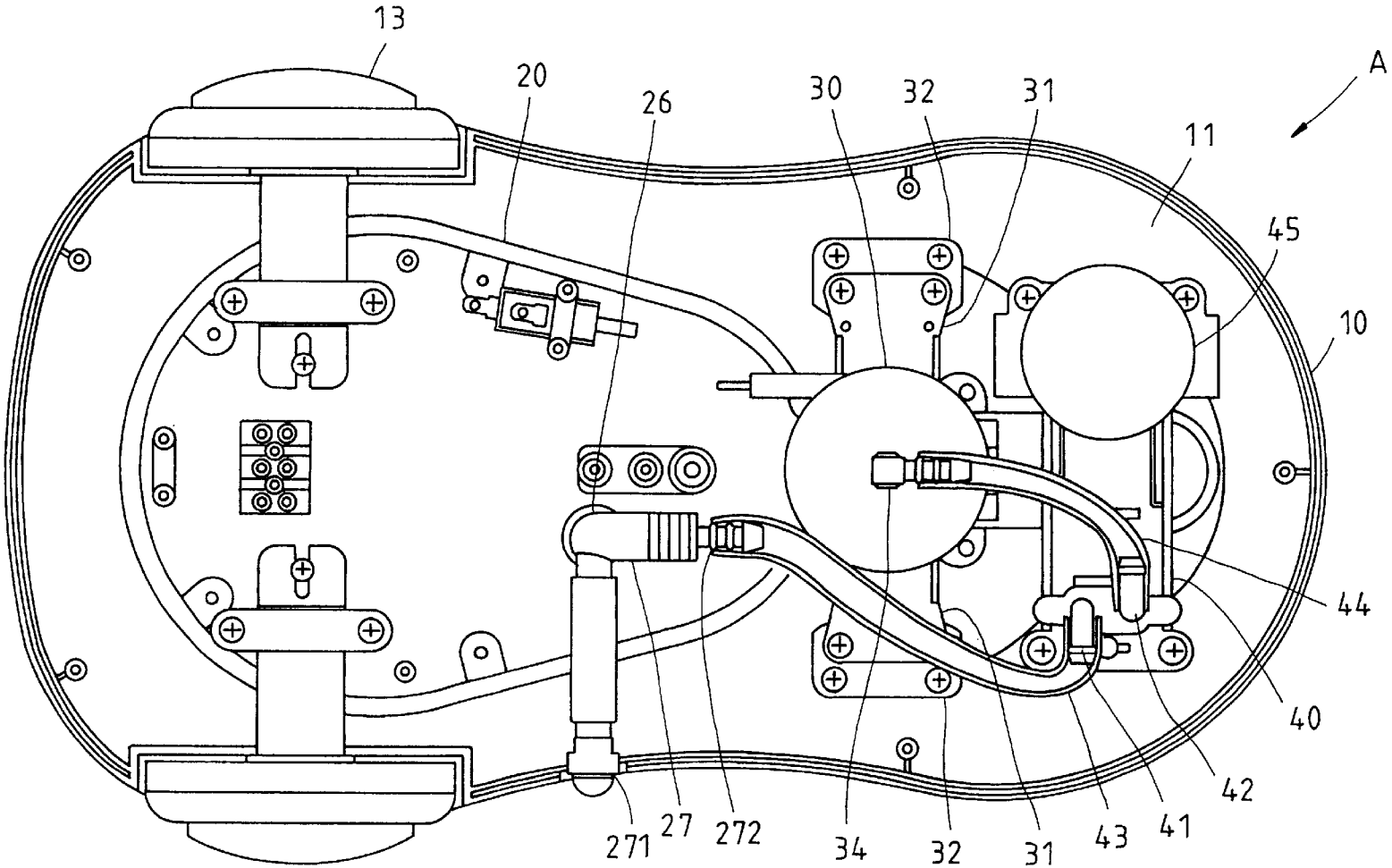
FIG. 4 is a bottom view of FIG. 3.
Figure 5:
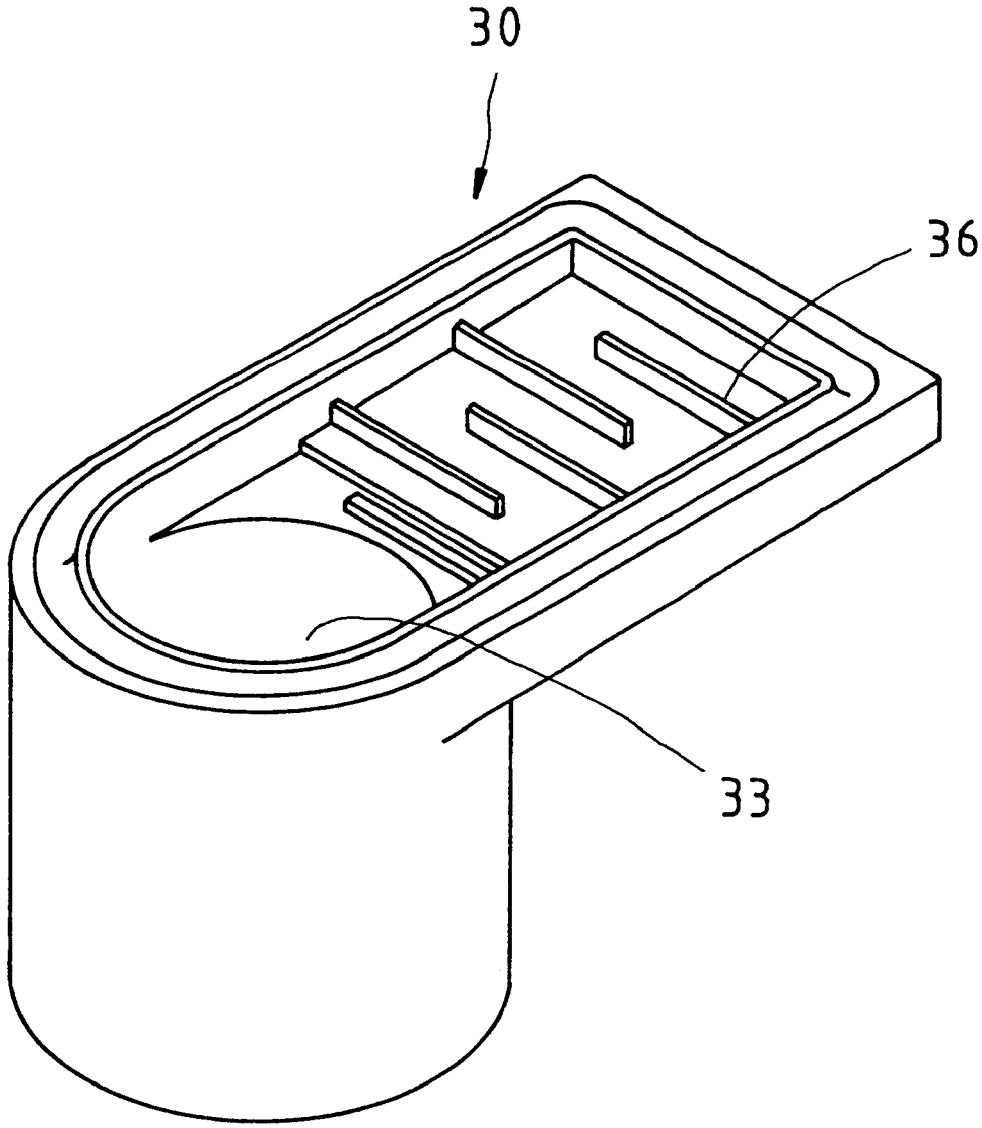
FIG. 5 is an enlarged view of a part of the steam/ironing dual mode cleaning apparatus shown in FIG. 2.

The steam boiler 30 is supported on a rack 31 inside the receiving chamber 11, and uses electric energy to produce heat energy for boiling water into steam. The rack 31 is fixedly fastened to the peripheral wall of the receiving chamber 11 inside the housing 10 through a heat insulator 32. The steam boiler 30 comprises an evaporation chamber 33 adapted to hold water for enabling water to be heated into steam, a water inlet fitting 34 disposed at the bottom side and adapted to guide water into the evaporation chamber 33, a heat-resisting sponge 331 arranged inside the evaporation chamber 33 and adapted to absorb water, preventing water from being carried with steam to the outside of the evaporation chamber 33, an aluminum steam tube 35 extended from the top side of the evaporation chamber 33 to the outside of the housing 10, the aluminum steam tube 35 having a steam outlet 351 for output of steam from the evaporation chamber 33, a plurality of dampers 36 alternatively arranged at two sides below the steam outlet 351 and adapted to guide condensed water back to the evaporation chamber 33 during delivery of steam through the steam outlet 351 (see FIGS. 3 and 5), and an overpressure protective device 37 adapted to discharge steam, preventing an overpressure in the evaporation chamber. The overpressure protective device 37 comprises a vent pipe 371 disposed at the top side of the evaporation chamber 33, a spring member 373 mounted in the vent pipe 371, a stopper 372 mounted in the vent pipe 371 and forced downwards by the spring member 373 to close the passage of the vent pipe 371, a safety connector 374 connected to the outer end of the vent pipe 371 and stopped at one end of the spring member 373 against the stopper 372, an exhaust pipe holder 376 fixedly provided at the housing 10, an exhaust pipe 375 connected between the safety connector 374 and the exhaust pipe holder 376 and adapted to guide discharged steam out of the housing 10. When the internal air pressure of the evaporation chamber 33 is within the normal range, the stopper 372 closes the passage of the vent pipe 371. In case the internal air pressure of the evaporation chamber 33 surpasses the set critical value, the stopper 372 is forced upwards by the internal air pressure of the evaporation chamber 33 to compress the spring member 373, enabling steam to pass from the evaporation chamber 33 through the vent pipe 371 and the exhaust pipe 375 to the outside of the housing 10 to relieve the internal pressure of the evaporation chamber 33. When the internal pressure of the evaporation chamber 33 drops below the set critical value, the spring member 373 immediately returns to its former shape and to force the stopper 372 back to the close position to close the passage of the vent pipe 371.

The water pump unit 40 is fixedly mounted inside the receiving chamber 11 of the housing 10 and disposed at the same elevation of the water tank unit 20 and the steam boiler 30, and controlled to pump water from tank body 21 of the water tank unit 20 to the steam boiler 30, comprising a water inlet fitting 41, a first water pipe 43 connected between the water inlet fitting 41 and the water outlet fitting 272 of the water tank unit 20 and adapted to guide water from the water tank unit 20 to the water pump unit 40, a water outlet fitting 42, a second water pipe 44 connected between the water outlet fitting 42 to the water inlet fitting 34 of the steam boiler 30 and adapted to guide water from the water pump unit 40 to the steam boiler 30, a motor pump 45, and a motor switch 46 adapted to control the operation of the motor pump 45. For convenient operation by the user,the motor switch 46 is mounted on the outside of the housing 10. When pressing the motor switch 46 to switch on the motor pump 5, water flows from the water tank unit 20 through water outlet fitting 272, the first water pipe 43 and the water inlet fitting 41 into the water pump unit 40, and then from the water pump unit 40 through the water outlet fitting 42, the second water pipe 44 and the water inlet fitting 34 into the steam boiler 30 for boiling into steam, for enabling steam to be delivered through the steam outlet 351 of the aluminum steam tube 35 for application.

As indicated above, the steam/ironing dual mode cleaning apparatus uses the water pump unit 40 to pump water from the water tank unit 20 to the steam boiler 30. This design enables the water tank unit 20, the steam boiler 30 and the water pump unit 40 to be arranged at the same elevation so that the vertical size of the steam/ironing dual mode cleaning apparatus can be minimized. The application of the water pump unit 40 prevents a reverse flow of water from the steam boiler 30 to the water tank unit 20, i.e., the steam boiler 30 is constantly provided with water during its operation. Further, the water level-actuated switch 28 automatically cuts off power supply when the water level in the tank body 21 drops below a predetermined range.

A prototype of steam/ironing dual mode cleaning apparatus has been constructed with the features of the annexed drawings. The steam/ironing dual mode cleaning apparatus functions smoothly to provide all of the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A steam/ironing dual mode cleaning apparatus comprising:

a housing, said housing comprising a receiving chamber;

a water tank unit mounted in said receiving chamber of said housing and adapted to hold water, said water tank unit comprising a water outlet fitting;

a steam boiler mounted in said receiving chamber of said housing and adapted to boil water into steam, said steam boiler to comprising a water inlet fitting;

a water pump unit mounted in said receiving chamber of said housing and arranged with said water tank unit and said steam boiler at the same elevation and adapted to pump water from said water tank unit to said steam boiler, said water pump unit comprising a water inlet fitting, a first water pipe connected between the water outlet fitting of said water tank unit and the water inlet fitting, of said water pump unit and adapted to guide water from said water tank unit to said water pump unit, a water outlet fitting, a second water pipe connected between the water outlet fitting of said water pump unit and the water inlet fitting of said steam boiler and adapted to guide water from said water pump unit to said steam boiler, and a water pump controlled to pump water from said first water pipe to said steam boiler through said second water pipe.

2. The steam/ironing dual mode cleaning apparatus of claim 1 wherein said steam boiler comprises an evaporation chamber adapted to receive water from said water pump unit for enabling received water to be heated into steam.

3. The steam/ironing dual mode cleaning apparatus of claim 2 wherein said steam boiler further comprises a plurality of dampers alternatively disposed at two sides and adapted to guide condensed water back to said evaporation chamber during delivery of steam from said evaporation chamber to the outside of said steam boiler.

4. The steam/ironing dual mode cleaning apparatus of claim 1 wherein said water tank unit comprises a tank body adapted to hold water, and a water level-actuated switch mounted inside said tank body and adapted to cut off power supply when the water level in said tank body drops below a predetermined range, said water level-actuated switch comprising an upright fixedly mounted in said tank body, a float arm, said float arm having a middle part pivoted to said upright, a first end, and a second end, a float fixedly fastened to the first end of said float arm, a push rod, said push rod having one end connected to the second end of said float arm and an opposite end inserted through a hole on a bottom sidewall of said tank body, a gasket fixedly mounted in said tank body around said push rod, and a water valve switch mounted on the outside of said tank body and adapted to cut off power supply from the steam/ironing dual mode cleaning apparatus when the water level in said tank body drops below a predetermined range, said float floating upwards with the water level in said tank body to turn said float arm in one direction and to force said push rod to switch on said water valve switch when the water level in said tank body rises, said float floating downwards with the water level in said tank body to turn said float arm in the reversed direction and to lift said push rod from said water valve switch when the water level in said tank body drops, causing said water valve switch to cut off power supply from the steam/ironing dual mode cleaning apparatus.

* * * * *